US009974709B2

(12) United States Patent
Brett

(10) Patent No.: US 9,974,709 B2
(45) Date of Patent: May 22, 2018

(54) NOZZLES

(71) Applicant: NuWhirl Systems Corporation, Corona, CA (US)

(72) Inventor: James Edward Brett, Corona, CA (US)

(73) Assignee: NuWhirl Systems Corporation, Corona, CA (US)

( * ) Notice: Subject to any disclaimer, the term of this patent is extended or adjusted under 35 U.S.C. 154(b) by 17 days.

(21) Appl. No.: 14/624,424

(22) Filed: Feb. 17, 2015

(65) Prior Publication Data

US 2015/0231029 A1 Aug. 20, 2015

Related U.S. Application Data

(60) Provisional application No. 61/941,271, filed on Feb. 18, 2014.

(51) Int. Cl.

| | |
|---|---|
| ***A61H 33/06*** | (2006.01) |
| ***A61H 33/02*** | (2006.01) |
| ***B01F 5/10*** | (2006.01) |

(52) U.S. Cl.

CPC ..... *A61H 33/027* (2013.01); *B01F 5/106* (2013.01)

(58) Field of Classification Search

CPC ..... A61H 33/025; A61H 33/0621
USPC ..... 4/541.1–541.5
See application file for complete search history.

(56) References Cited

U.S. PATENT DOCUMENTS

| | | | | |
|---|---|---|---|---|
| 5,514,267 | A | 5/1996 | Machiya et al. | |
| D375,315 | S | 11/1996 | Paul-Johansson | |
| 6,264,122 | B1 * | 7/2001 | Perdreau | A61H 33/027 239/434 |
| 6,355,913 | B1 | 3/2002 | Authier et al. | |
| 6,427,257 | B1 | 8/2002 | Castellote | |
| 6,476,363 | B1 | 11/2002 | Authier et al. | |
| 6,488,408 | B1 | 12/2002 | Laflamme et al. | |
| 7,327,275 | B2 | 2/2008 | Brochu et al. | |
| 7,419,406 | B2 | 9/2008 | Brochu et al. | |

(Continued)

FOREIGN PATENT DOCUMENTS

| | | |
|---|---|---|
| KR | 20130054090 | 5/2013 |
| WO | WO2007049377 | 5/2007 |
| WO | WO2013073732 | 5/2013 |

OTHER PUBLICATIONS http://www.takeshita.com/micro-bubble-bath.html in 6 pages.

(Continued)

*Primary Examiner* — Lori Baker
(74) *Attorney, Agent, or Firm* — Knobbe, Martens, Olson & Bear LLP

(57) ABSTRACT

A nozzle can produce bubbles from a liquid saturated with gas desirable in bathing. The nozzle can have a housing forming a first chamber for receiving a liquid. The nozzle can have an intermediate chamber located between the outlet of the first chamber and the inlet of the outflow passage. The nozzle can have a generally cylindrical structure enclosing the outflow passage and having a central longitudinal axis extending into the outlet of the first chamber. The intermediate chamber can have a first wall generally perpendicular to said axis and surrounding the outlet from the first chamber and second wall spaced from said first wall and generally parallel thereto and surrounding the inlet to the outflow passage.

24 Claims, 5 Drawing Sheets

(56) References Cited

U.S. PATENT DOCUMENTS

| | | | |
|---|---|---|---|
| 7,440,820 | B2 | 10/2008 | Gougerot et al. |
| 7,489,986 | B1 | 2/2009 | Laflamme et al. |
| 7,490,369 | B2 | 2/2009 | Cunningham |
| 7,503,082 | B2 | 3/2009 | Castellote |
| D601,127 | S | 9/2009 | Rivard et al. |
| 7,593,789 | B2 | 9/2009 | Gougerot et al. |
| 7,619,181 | B2 | 11/2009 | Authier |
| 7,701,679 | B2 | 4/2010 | Brochu et al. |
| 7,843,357 | B2 | 11/2010 | Brochu et al. |
| 7,866,572 | B2 | 1/2011 | Ichige |
| 7,982,625 | B2 | 7/2011 | Brochu et al. |
| 7,997,563 | B2 | 8/2011 | Abe et al. |
| 8,104,110 | B2 | 1/2012 | Caudill et al. |
| 8,150,552 | B2 | 4/2012 | Brochu et al. |
| 8,164,470 | B2 | 4/2012 | Brochu et al. |
| 8,201,811 | B2 | 6/2012 | Cunningham et al. |
| 8,205,277 | B2 | 8/2012 | Yamasaki et al. |
| 8,266,738 | B2 | 9/2012 | Castellote et al. |
| 8,292,271 | B2 | 10/2012 | Fujisato et al. |
| 8,322,634 | B2 | 12/2012 | Cunningham et al. |
| 8,579,266 | B2 | 11/2013 | Cunningham et al. |
| 8,624,749 | B2 | 1/2014 | Brochu et al. |
| 8,646,759 | B2 | 2/2014 | Cunningham et al. |
| 8,720,867 | B2 | 5/2014 | Cunningham et al. |
| 9,060,916 | B2 | 6/2015 | Cunningham et al. |
| 2006/0172071 | A1 | 8/2006 | Barceau |
| 2010/0070059 | A1 | 3/2010 | Laflamme |
| 2011/0035870 | A1 | 2/2011 | Caudill |
| 2012/0117724 | A1 | 5/2012 | Caudill |
| 2013/0068631 | A1 | 3/2013 | Brochu |

OTHER PUBLICATIONS http://rinnai.jp/products/bathroom/micro_bubble/mb_point in 2 pages.
http://www.hydro-bath.co.jp/cgi-bin/hydro-bath/siteup.cgi?category=2&page=0 in 2 pages.
http://www.nanoplanet.jp/index.html in 3 pages.
http://www.sunworks.co.jp/silk/silk01.html in 12 pages.
http://i-feel-science.com/ in 8 pages.
http://www.seiko-ep.co.jp/ in 2 pages.
http://ishimaru-shoko.com/product/mb/sawayaka-bizin-dx.html in 5 pages.
http://www.nikuni.co.jp/equip/s-0220.html in 2 pages.
http://www.felco.ne.jp/felco/jat/wp-con/e19.html in 2 pages.
Micro-Bubble Applications diagram by Riverforest Corporation dated Dec. 19, 2013 in 1 page.
Blue print drawings of a nozzle for a Bubbletank in 3 pages.
Product pictures.

* cited by examiner

NOZZLES

CROSS-REFERENCE TO RELATED APPLICATIONS

This application claims the benefit of U.S. Provisional Application No. 61/941,271, filed Feb. 18, 2014 entitled "NOZZLES" which is incorporated herein by reference in its entirety.

BACKGROUND OF THE INVENTION

Field of the Invention

This disclosure relates to nozzles, systems containing them and methods of using them. In particular, this disclosure relates to nozzles that can produce bubbles from a liquid saturated with gas. The nozzles can produce micro bubbles which are desirable in bathing.

Background of the Invention

Nozzles are well known for controlling the direction or characteristics of a fluid flow as it exits an enclosed chamber or pipe.

Some nozzles are designed to cause liquid flowing through them (such as water) that is saturated with gas (such as air), to release gas in the form of micro bubbles. Micro bubbles are becoming popular in bathing. In a shower, for example, micro bubbles in the water can produce a pleasing bathing experience. Micro bubbles in the water of a bath can appear like a white cloud, otherwise known as a "milk bath," which is similarly pleasing and may have some hygienic or health benefits.

While production of some micro bubbles may have some utility, it is preferred that the generation of micro bubbles be maximized otherwise, for example, bath water may have a relatively fewer micro bubbles and the appearance and/or effects may be correspondingly diminished. Maximizing the production of micro bubbles, however, typically requires rather complex nozzle systems that are therefore relatively expensive.

It would be advantageous if a relatively simple nozzle could be designed to compete with more complex and therefore more expensive designs and yet match or substantially match the degree of micro bubble production.

SUMMARY OF THE INVENTION

This disclosure provides nozzles, particularly nozzles suitable for generating micro bubbles, comprising a chamber having an inlet port and an outlet port, the outlet port communicating with a discharge channel or outflow passage having an inlet end adjacent to, but offset from, the outlet port and an outlet end, the outlet end being wider than the inlet end. This structure can cause a pressure drop in liquid traveling from the inlet end to the outlet end. This disclosure provides such nozzles and nozzle systems comprising them, including those that have only one such discharge channel.

The discharge channel or outflow passage can be located in a generally tubular structure having a central longitudinal axis. The nozzle can have a plurality of discharge channels but it is preferred to have a single discharge channel. Preferably the discharge channel or outflow passage is offset with respect to the central axis of the tubular structure.

The discharge channel or outflow passage can have an increasing diameter from the inward end to the outlet end, such as one that increases continually and smoothly. This can cause a pressure drop in liquid travelling through the discharge channel or outflow passage causing gas dissolved in the liquid to form bubbles therein.

The outlet port from the chamber can be offset with respect to the inlet end of the discharge channel.

The outlet port of the chamber can communicate with the discharge channel via an intermediate chamber. The intermediate channel can have a general disc like shape. The intermediate chamber can be generally circular in shape and have a center aligned with the central axis of the tubular structure around the discharge channel or outflow passage.

The inlet port to the chamber can be formed by a generally tubular structure. The chamber can be generally circular in cross section around the outlet port and the inlet tube can be arranged substantially tangentially to that circular cross section.

The chamber can comprise a curved inside wall, such as generally semihemaspherical. Preferably the curved internal wall is integrally formed with the section having a circular cross section and is located at the opposing end of the chamber to the outlet port.

The inlet tube to the chamber and the tube around the discharge channel can extend in different directions and can be arranged at approximately 90° to one another.

These shapes, along with the tangential inlet pipe can advantageously cause incoming liquid to swirl vigorously around the chamber.

This disclosure provides a nozzle comprising a housing forming a first chamber for receiving a liquid, the chamber having an inlet and an outlet communicating with an outflow passage also having an inlet and an outlet an intermediate chamber located between the outlet of the first chamber and the inlet of the outflow passage; a generally cylindrical structure enclosing the outflow passage and having a central longitudinal axis extending into the outlet of the first chamber; the intermediate chamber having a first wall generally perpendicular to said axis and surrounding the outlet from the first chamber and second wall spaced from said first wall and generally parallel thereto and surrounding the inlet to the outflow passage, said inlet being offset with respect to said axis and only on one side of said axis; said outflow passage being generally parallel to said axis and said outflow passage inlet being smaller than said outflow passage outlet.

This disclosure provides a nozzle for generating micro bubbles in a liquid comprising: a flow passage having an inlet and an outlet and a gradually increasing diameter, in the direction of flow of the liquid when the nozzle is in use, from adjacent said inlet to adjacent said outlet; said passage being generally straight and the nozzle having one such flow passage.

This disclosure provides a nozzle for generating micro bubbles in a liquid comprising: a housing forming a first chamber for receiving a liquid, the chamber having an inlet and an outlet communicating with an outflow passage also having an inlet and an outlet, said inlets and outlets being generally circular in cross section; an intermediate chamber located between the outlet of the first chamber and the inlet of the outflow passage; a generally cylindrical structure enclosing the outflow passage and having a central longitudinal axis extending into the outlet of the first chamber; the intermediate chamber having a first wall generally perpendicular to said axis and surrounding the outlet from the first chamber and second wall spaced from said first wall and generally parallel thereto and surrounding the inlet to the outflow passage, said inlet being offset with respect to the outlet from said first chamber, such that said second wall faces the outlet from the first chamber and the inlet of the outflow passage faces said first wall; said outflow passage being generally parallel to said axis and said outflow passage inlet being smaller than said outflow passage outlet, the nozzle having a single such outflow passage.

This disclosure provides baths or showers incorporating at least one nozzle disclosed herein.

This disclosure provides a method of making micro bubbles which comprises supplying water saturated with air to a nozzle disclosed herein.

BRIEF DESCRIPTION OF THE DRAWINGS

Some preferred features of this disclosure will now be more particularly described by reference in and to the following drawings, which are only exemplary of the disclosure.

DETAILED DESCRIPTION OF THE PREFERRED EMBODIMENT

Figure 1:
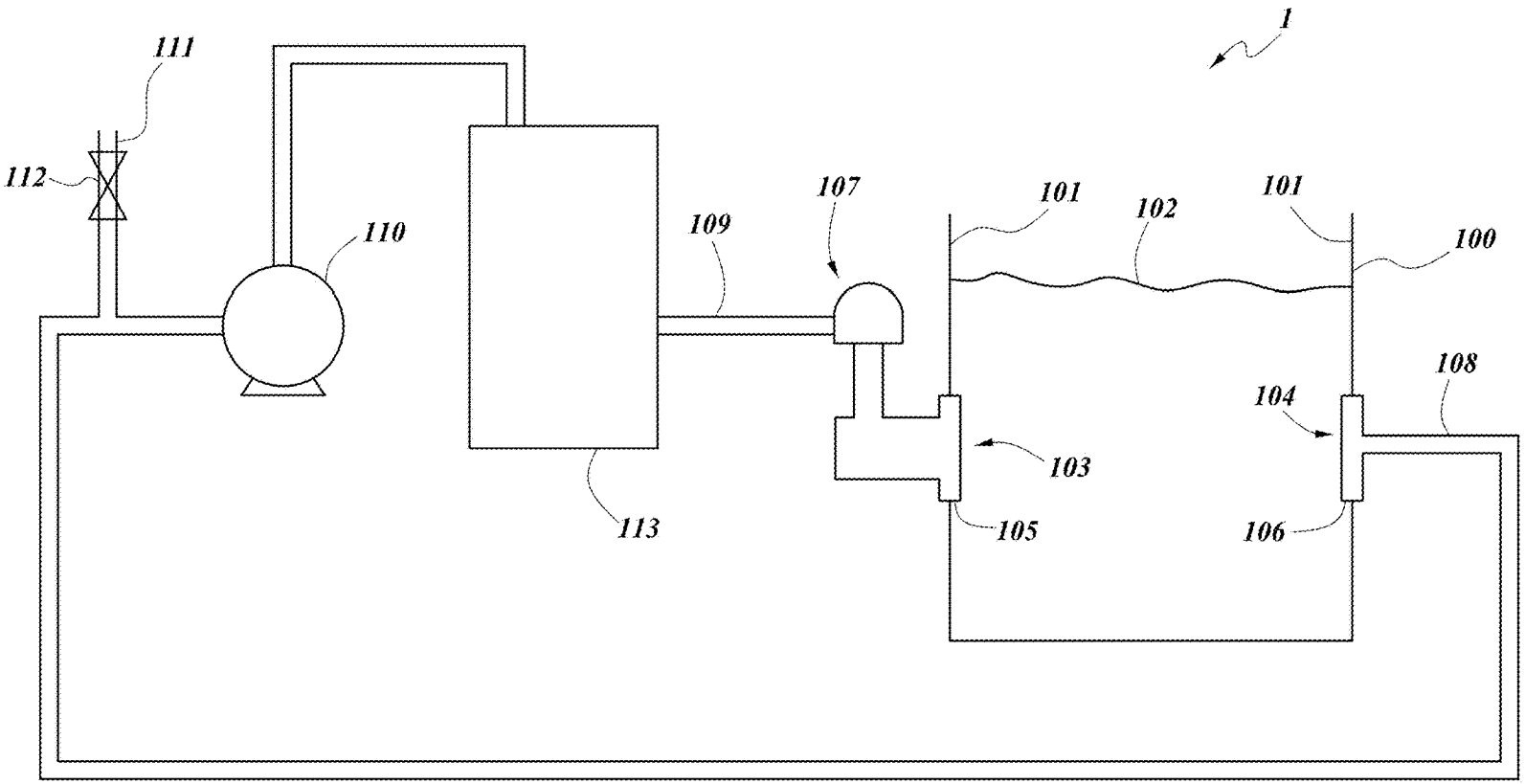
FIG. 1 is a schematic representation of a system comprising a nozzle according to this disclosure connected to a supply of water saturated with air and connected to a bath.

FIG. 1 illustrates a hydrotherapy system 1 comprising a bath 100 having side walls 101 so as to contain water 102 therein. Side walls 101 have holes 103 and 104 in which fittings 105 and 106, respectively, are attached in a conventional manner so as to attach to the outside of the bath a nozzle assembly 107 and pipe 108, respectively. Nozzle 107 receives an inlet pipe 109.

Pipe 108 is a return pipe for recycling water from the bath 100 driven by a pump 110. Pump 110 draws water past an inlet 111 to the system that is open to a supply of gas such as air and has a restriction feature 112 to regulate the amount of air drawn into the system.

Pump 110 draws water and air into a mixing tank 113 where, in a manner known in the art, air is caused to be dissolved in or to saturate the water for supply along pipe 109 to nozzle assembly 107. Alternatively, air can be supplied directly into mixing chamber 113.

Figure 2:
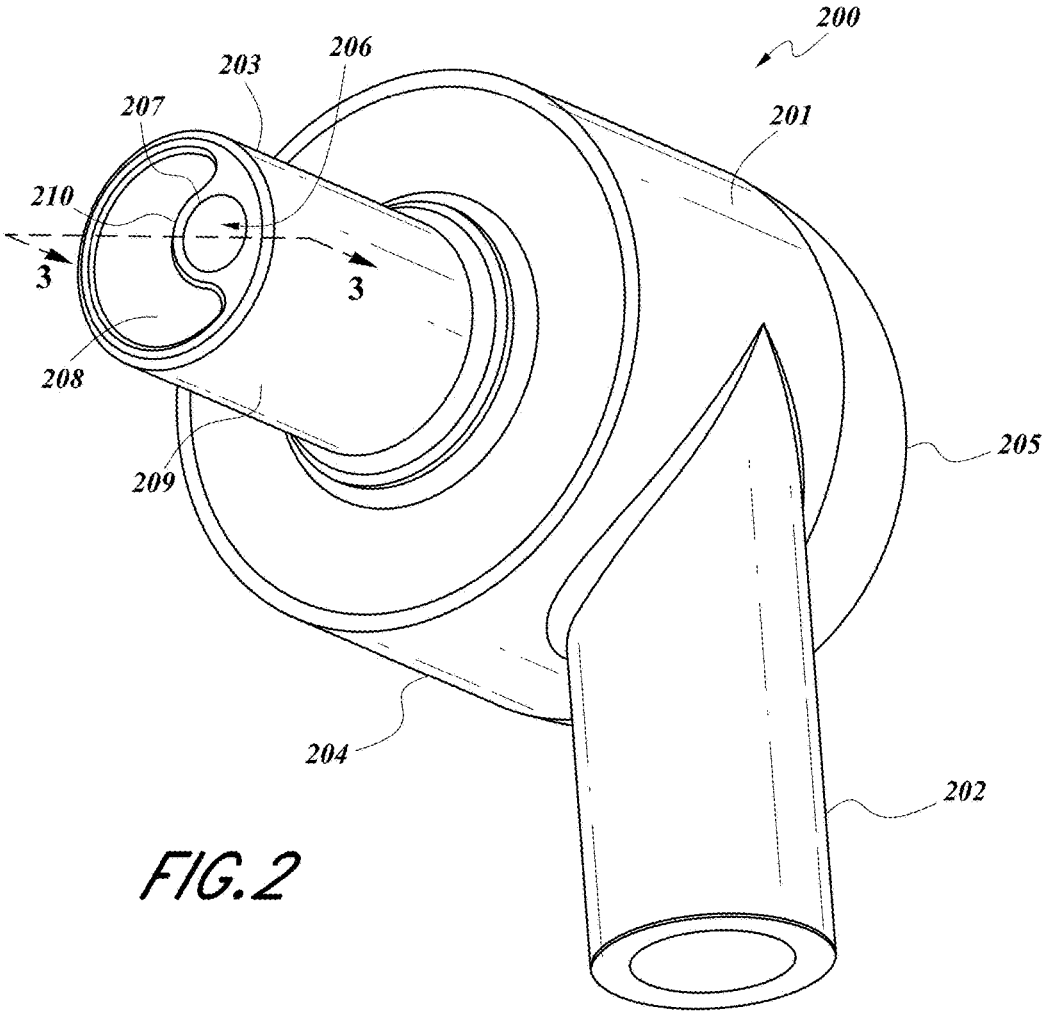
FIG. 2 is a schematic representation of a nozzle according to this disclosure.

FIG. 2 illustrates a nozzle assembly 200 comprising an inlet housing 201 having attached thereto an inlet tube 202 and an outlet tube 203. Housing 201 comprises a generally cylindrical section 204 and a distal, generally hemispherical section 205. Inlet tube 202 is arranged tangentially to cylindrical section 204. Tubes 202 and 203 can be threaded for attachment to other system components.

Outlet tube 203 comprises a discharge channel or outflow passage 206 having an outlet 207. Outlet tube 203 forms an internal space 208 between its outer wall 209 and an internal wall 210 forming the outflow passage 206. As shown, inlet tube 202 it is arranged at about 90° or a right angle to outflow tube 203.

Figure 3:
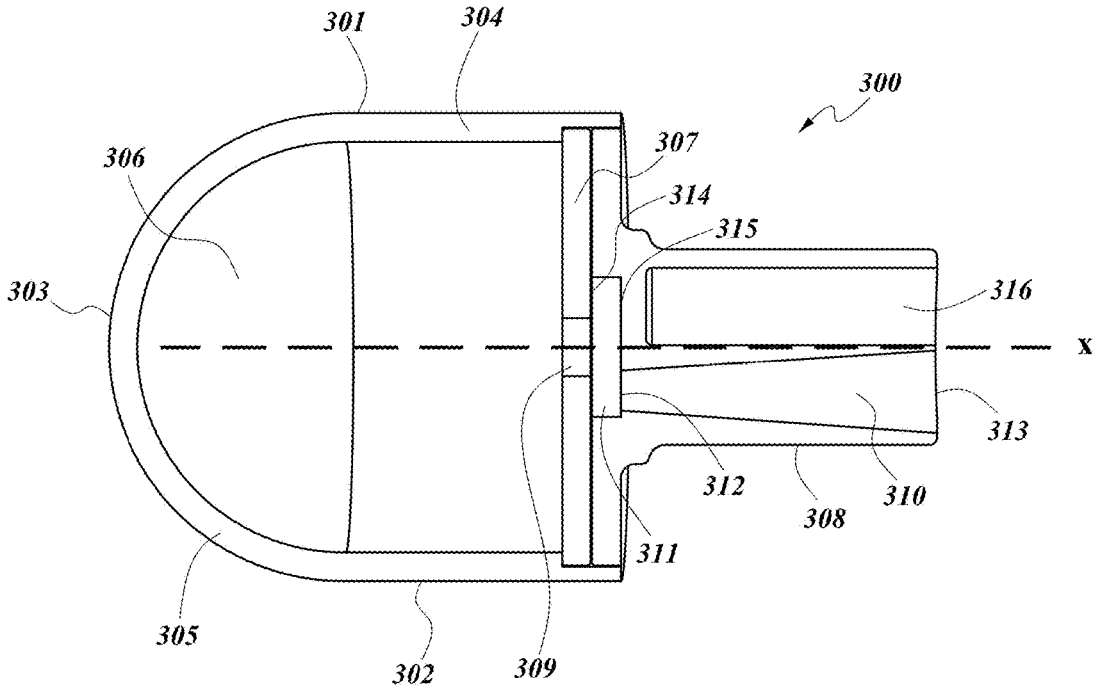
FIG. 3 is a schematic, cross sectional view of the nozzle of FIG. 2 taken along the line 3-3 in the direction of the indicated arrows.

FIG. 3 illustrates a nozzle assembly 300 comprising an inlet housing 301 comprising a generally cylindrical section 302 and a distal, generally curved section 303. These sections are formed by walls 304 and 305 respectively and form between them an internal inlet chamber 306. The remainder of the chamber is formed by a cross wall 307. Attached thereto or formed therewith is an outlet tube 308 which is generally cylindrical and has a central axis X. Centered in cross wall 307, which is generally perpendicular to axis X, is an outlet 309 from chamber 306 which is in fluid communication with an outflow passage 310 by means of intermediate chamber 311. Outflow passage 310 has an inlet 312 and an outlet 313. Outlet passage 310 has a diameter that gradually increases from inlet 312 to outlet 313.

Intermediate chamber 311 is formed by opposing walls 314 and 315. Outlet 309 from inlet chamber 306 is centered on wall 314 on axis X. Inlet 312 to the discharge outflow passage 310 is offset with respect to outlet 309 from the inlet chamber 306 to disrupt the flow of liquid leaving inlet chamber 306 by means of outlet 309 and causing turbulence in intermediate chamber 311 before the water reaches the inlet 312 of outflow passage 310. The offset can be such that there is no overlap of outlet 309 with inlet 312. Thus, opposite outlet 309 is wall 315 along axis X.

Typically, the nozzles herein are formed with a single outflow passage, such as 310.

Outlet tube 308 can have a space 316 adjacent thereto or, alternatively, that space can be occupied by material forming outlet tube 308.

Figure 4:
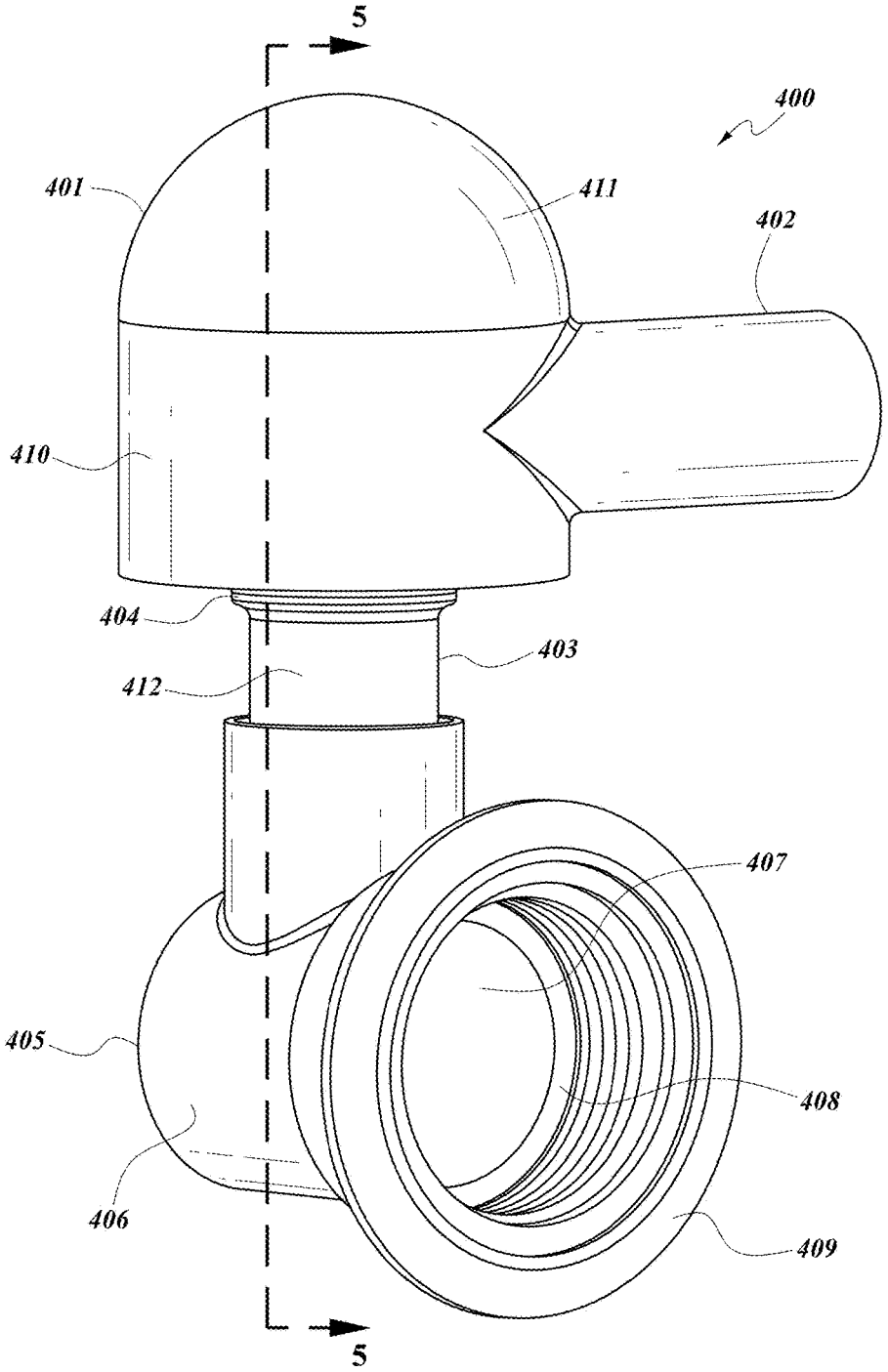
FIG. 4 is a schematic, perspective view of a nozzle according to this disclosure connected to a fitting suitable for attachment to the wall of a bath.

FIG. 4 illustrates a nozzle assembly 400 having an inlet section 401 having an inlet tube 402 and a micro bubble generating section 403 connected to an outlet 404 from inlet section 401. Micro bubble generator 403 is connected to an outlet section comprising a housing 405 having walls 406 forming an internal chamber 407. Chamber 407 communicates with an outlet 408 having a flanged fitting 409 for attachment to a corresponding hole in the wall of a bath (not shown).

Inlet section 401 has a substantially cylindrical section 410 and a distal, substantially hemispherical section 411. Inlet tube 402 is arranged in a generally tangential manner with respect to cylindrical section 410.

Micro bubble generator 403 is a generally cylindrical or tubular structure 412, which is arranged substantially perpendicular to inlet tube 402.

Walls 406 of housing 405 are generally cylindrical and are arranged substantially perpendicularly to tube 412 of bubble generator 403.

In use, a supply of water having air dissolved therein or saturated with air is supplied to inlet 402. The water enters a chamber in section 401 and circulates therein before leaving the chamber by means of outlet 404. Micro bubbles are caused to be generated from the water by micro bubble generator 403. Water containing micro bubbles then enters housing 405 and the chamber 407 formed by walls 406 and are lead through outlet 408 into a bath (not shown).

Figure 5:
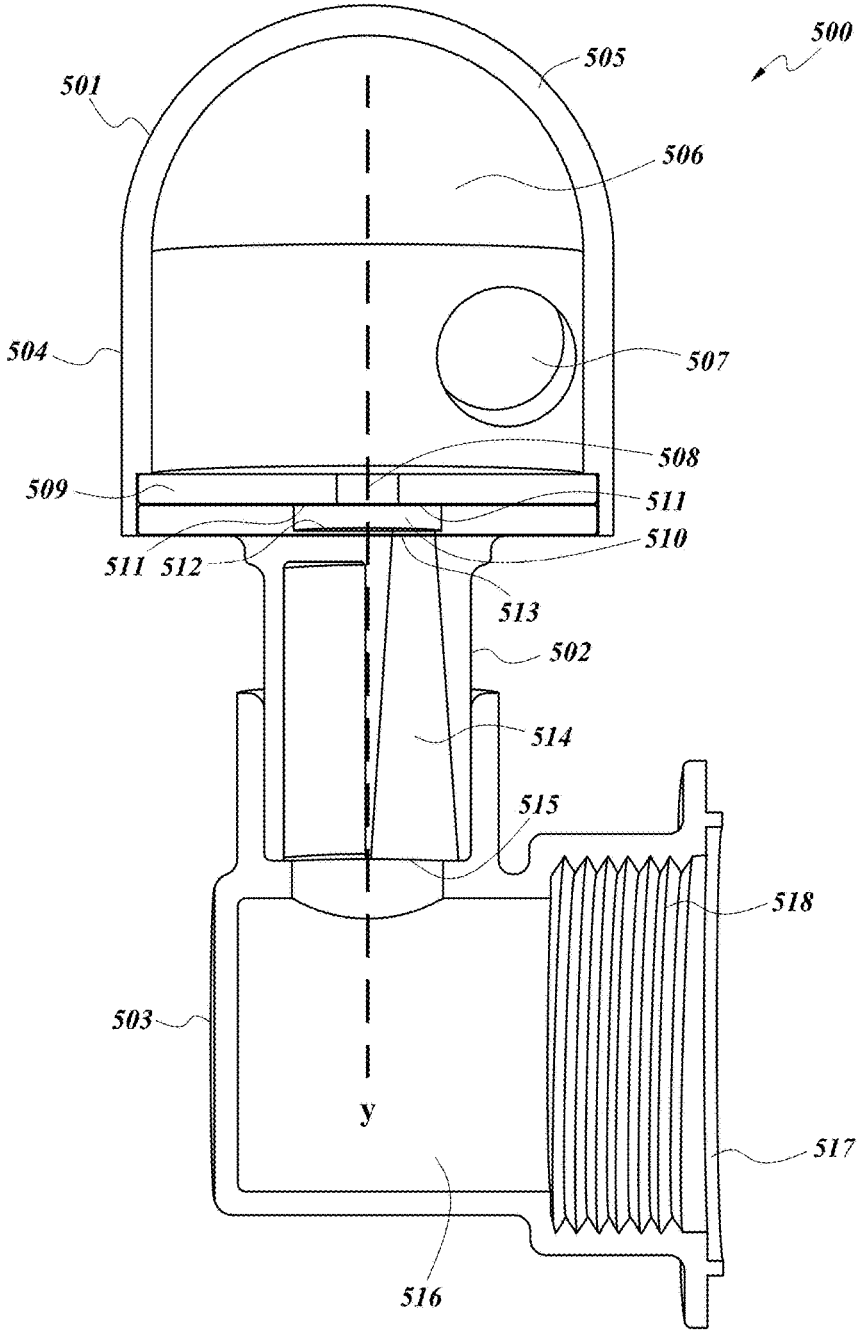
FIG. 5 is a schematic, cross sectional view along the line 5-5 shown in FIG. 4 and in the direction of the indicated arrows.

FIG. 5 illustrates a nozzle assembly 500 having an inlet section 501 communicating with a micro bubble generator section 502 which in turn communicates with an outlet section 503. Inlet section 501 comprises substantially cylindrical walls 504 and a distal, substantially hemispherical wall section 505 forming an inlet chamber 506 therein. The inlet chamber has an inlet port 507 and an outlet port 508 formed in a wall 509 which extends across the substantially cylindrical section 504.

Outlet 508 communicates with an intermediate chamber 510. Outlet 508 and intermediate chamber 510 are both centered on an axis Y that is central to wall 509 and the chamber 506. Intermediate chamber 510 has wall 511 (surrounding outlet 508) and an opposing wall 512, which together form intermediate chamber 510. Formed in intermediate chamber wall 512 and offset from both the outlet 508 and the axis Y is an inlet 513 to an outflow passage or discharge passage 514 which has a gradually increasing diameter until its outlet 515 into a chamber 516 formed in outlet section 503. Chamber 516 has an outlet 517 which comprises a flanged threaded section 518 for receiving a flanged threaded fitting (not shown) to fit the nozzle assembly to the wall of a bath.

What is claimed is:

1. A nozzle comprising:

a housing forming a first chamber for receiving a liquid, the chamber having an inlet and an outlet communicating with an outflow passage also having an inlet and an outlet;

an intermediate chamber located between the outlet of the first chamber and the inlet of the outflow passage;

a generally cylindrical structure enclosing the outflow passage and having a central longitudinal axis extending into the outlet of the first chamber;

the intermediate chamber having a first wall generally perpendicular to said axis and surrounding the outlet from the first chamber and second wall spaced from said first wall and generally parallel thereto and surrounding the inlet to the outflow passage, said inlet being offset with respect to said axis and only on one side of said axis;

said outflow passage being generally parallel to said axis and said outflow passage inlet being smaller than said outflow passage outlet.

2. A nozzle as claimed in claim 1, wherein said first wall defines one end of the first chamber and is generally flat and the other end of the first chamber comprises a second wall that is curved outwardly with respect to the interior of the first chamber.

3. A nozzle as claimed in claim 2, wherein said first and second walls are joined together by a substantially cylindrical wall, the first, second and substantially cylindrical walls forming the first chamber.

4. A nozzle as claimed in claim 1, wherein the inlet to the first chamber comprises a passageway having a longitudinal axis, said axis being offset from and generally perpendicular to the central longitudinal axis.

5. A nozzle as claimed in claim 3, wherein the inlet to the first chamber comprises a passageway disposed substantially tangentially to said cylindrical walls.

6. A nozzle as claimed in claim 1, wherein said outflow passage has a gradually increasing diameter, in the direction of flow of the liquid when the nozzle is in use, from adjacent said inlet of said outflow passage to adjacent said outlet of said outflow passage, said passage being generally straight.

7. A nozzle for generating microbubbles in a liquid comprising:

a flow passage for generating microbubbles, the flow passage having an inlet and an outlet and a gradually increasing diameter, in the direction of flow of the liquid when the nozzle is in use, from adjacent said inlet to adjacent said outlet; said passage being generally straight and the nozzle having one such flow passage, wherein the inlet and outlet of the flow passage generally align along the direction of flow of the liquid through the flow passage.

8. A nozzle as claimed in claim 7, comprising:

a housing forming a first chamber for receiving the liquid, the chamber having an inlet and an outlet communicating with the flow passage;

an intermediate chamber located between the outlet of the first chamber and the inlet of the flow passage;

the intermediate chamber having a first wall generally perpendicular to the direction of flow of the liquid through the outlet of the first chamber when the nozzle is in use and surrounding the outlet from the first chamber and second wall spaced from said first wall and generally parallel thereto and surrounding the inlet to the flow passage.

9. A nozzle as claimed in claim 8, wherein said first wall defines one end of the first chamber and is generally flat and the other end of the first chamber comprises a second wall that is curved outwardly with respect to the interior of the first chamber.

10. A nozzle as claimed in claim 9, wherein said first and second walls are joined together by a substantially cylindrical wall, the first, second and substantially cylindrical walls forming the first chamber.

11. A nozzle as claimed in claim 8, wherein the inlet to the first chamber comprises a passageway having a longitudinal axis, said axis being offset from and generally perpendicular to the direction of flow of the liquid in the flow passage when the nozzle is in use.

12. A nozzle as claimed in claim 10, wherein the inlet to the first chamber comprises a passageway disposed substantially tangentially to said cylindrical walls.

13. A nozzle for generating microbubbles in a liquid comprising:

a housing forming a first chamber for receiving a liquid, the chamber having an inlet and an outlet communicating with an outflow passage also having an inlet and an outlet, said inlets and outlets being generally circular in cross section;

an intermediate chamber located between the outlet of the first chamber and the inlet of the outflow passage;

a generally cylindrical structure enclosing the outflow passage and having a longitudinal axis extending into the outlet of the first chamber;

the intermediate chamber having a first wall generally perpendicular to said axis and surrounding the outlet from the first chamber and second wall spaced from said first wall and generally parallel thereto and surrounding the inlet to the outflow passage, said inlet being offset with respect to the outlet from said first chamber, such that said second wall faces the outlet from the first chamber and the inlet of the outflow passage faces said first wall;

said outflow passage being generally parallel to said axis and said outflow passage inlet being smaller than said outflow passage outlet, the nozzle having a single such outflow passage.

14. A nozzle as claimed in claim 13, wherein said first wall defines one end of the first chamber and is generally flat and the other end of the first chamber comprises a second wall that is curved outwardly with respect to the interior of the first chamber.

15. A nozzle as claimed in claim 14, wherein said first and second walls are joined together by a substantially cylindrical wall, the first, second and substantially cylindrical walls forming the first chamber.

16. A nozzle as claimed in claim 13, wherein the inlet to the first chamber comprises a passageway having a longitudinal axis, said axis being offset from and generally perpendicular to the longitudinal axis of the generally cylindrical structure.

17. A nozzle as claimed in claim 16, wherein the inlet to the first chamber comprises a passageway disposed substantially tangentially to said cylindrical wall.

18. A nozzle as claimed in claim 13, wherein said outflow passage has a gradually increasing diameter, in the direction of flow of the liquid when the nozzle is in use, from adjacent said inlet of said outflow passage to adjacent said outlet of said outflow passage, said passage being generally straight.

19. A bath or shower incorporating at least one nozzle according to claim 1.

20. A bath or shower incorporating at least one nozzle according to claim 7.

21. A bath or shower incorporating at least one nozzle according to claim 13.

22. A bathing apparatus as claimed in claim 19, comprising a pump connected by at least one pipe to a mixing chamber configured to mix air with water supplied through the at least one pipe by the pump and saturate said water with dissolved air, when in use, and at least one further pipe for conducting said water saturated with air to said at least one nozzle.

23. A bathing apparatus as claimed in claim 20, comprising a pump connected by at least one pipe to a mixing chamber configured to mix air with water supplied through the at least one pipe by the pump and saturate said water with dissolved air, when in use, and at least one further pipe for conducting said water saturated with air to said at least one nozzle.

24. A bathing apparatus as claimed in claim 21, comprising a pump connected by at least one pipe to a mixing chamber configured to mix air with water supplied through the at least one pipe by the pump and saturate said water with dissolved air, when in use, and at least one further pipe for conducting said water saturated with air to said at least one nozzle.

* * * * *